US011143017B2

(12) United States Patent
Wang et al.

(10) Patent No.: US 11,143,017 B2
(45) Date of Patent: Oct. 12, 2021

(54) PACKAGING FOR ELECTRONICS IN DOWNHOLE ASSEMBLIES

(71) Applicant: Baker Hughes Incorporated, Houston, TX (US)

(72) Inventors: Weiqiang Wang, Houston, TX (US); Robert Reinertsen, Spring, TX (US); Edward Glenn Burroughs, Houston, TX (US); Bernd Dreyer, Uetze (DE); Cord Huber, Gehrden (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 176 days.

(21) Appl. No.: 15/619,051

(22) Filed: Jun. 9, 2017

(65) Prior Publication Data

US 2017/0275984 A1 Sep. 28, 2017

Related U.S. Application Data

(63) Continuation-in-part of application No. 14/198,051, filed on Mar. 5, 2014, now abandoned.

(51) Int. Cl.
*E21B 47/017* (2012.01)

(52) U.S. Cl.
CPC ..... *E21B 47/017* (2020.05)

(58) Field of Classification Search
CPC ..... E21B 47/011; E21B 47/01
See application file for complete search history.

(56) References Cited

U.S. PATENT DOCUMENTS 3,317,797 A 5/1967 Webb
3,586,917 A 6/1971 Oates
3,596,140 A 7/1971 Walsh
3,760,090 A 9/1973 Fowler
4,547,833 A 10/1985 Sharp
5,212,495 A 5/1993 Winkel et al.
5,251,708 A 10/1993 Perry et al.
5,476,421 A 12/1995 Moore et al.
5,547,028 A 8/1996 Owens et al.
5,730,217 A 3/1998 Owens et al.
5,931,000 A 8/1999 Turner et al.
6,134,892 A 10/2000 Turner et al.
6,142,244 A 11/2000 Hesse
6,422,782 B1 7/2002 Wentworth
(Continued)

FOREIGN PATENT DOCUMENTS

WO 2011094429 A2 10/2011

OTHER PUBLICATIONS

European Search Report for related EP Application No. 15758843.5, dated Oct. 13, 2017, 8 pages.
(Continued)

*Primary Examiner* — Robert E Fuller
(74) *Attorney, Agent, or Firm* — Cantor Colburn LLP

(57) ABSTRACT

A downhole device configured to be inserted into a borehole includes a device body having an outer surface and a recess formed in the outer surface, a cover covering the recess to form a first cavity, and a shock-absorber configured to support an electrical module within the first cavity, the shock-absorber disposed between a base of the first cavity and the cover opposite the base. The downhole device also includes a vibration-damping layer disposed between the base of the first cavity and the cover, the vibration-damping layer configured to dampen vibration of the electrical module.

20 Claims, 7 Drawing Sheets

(56) References Cited

U.S. PATENT DOCUMENTS

| | | | |
|---|---|---|---|
| 6,429,653 | B1 | 8/2002 | Kruspe et al. |
| 7,777,352 | B2 | 8/2010 | Mahler et al. |
| 2002/0053471 | A1 | 5/2002 | Blair et al. |
| 2004/0140090 | A1 | 7/2004 | Mason et al. |
| 2009/0290294 | A1 | 11/2009 | Prest |
| 2010/0000311 | A1 | 1/2010 | Nakajima et al. |
| 2010/0108306 | A1 | 5/2010 | Cooper |
| 2010/0224410 | A1 | 9/2010 | Wassell et al. |
| 2013/0235537 | A1 | 9/2013 | Swett et al. |
| 2014/0260591 | A1 | 9/2014 | Rodgers et al. |
| 2015/0252666 | A1 | 9/2015 | Wang et al. |

OTHER PUBLICATIONS

Fillion, Ray; "Advanced Packaging Technology for Leading Edge Microelectronics and Flexible Electronics"; http://people.ccmr.cornell.edu/-cober/mse542/page2, Jun. 30, 2006, 3 pages.

Notification of Transmittal of the International Search Report and the Written Opinion of the International Searching Authority, or the Declaration; PCT/US2015/017280; dated Jun. 3, 2015; 15 pages.

Notification of Transmittal of the International Search Report and the Written Opinion of the International Searching Authority, or the Declaration; PCT/US2018/036387; dated Sep. 20, 2018; 12 pages.

PACKAGING FOR ELECTRONICS IN DOWNHOLE ASSEMBLIES

CROSS REFERENCE TO RELATED APPLICATIONS

The present application is a continuation-in-part of U.S. patent application Ser. No. 14/198,051 filed Mar. 4, 2015, the entire disclosure of which is incorporated herein by reference.

BACKGROUND

Embodiments of the invention relate to downhole segments of downhole assemblies for use in boreholes, and in particular to packaging for electronics in downhole assemblies.

Electrical devices are used in all types of environments including extremes of temperatures, vibration and shock. In downhole environments, such as oil wells or boreholes, downhole pipes are subjected to mechanical shock and vibration during drilling operations or well completion operations. Electrical circuitry in the downhole pipes may be damaged by the mechanical shock and vibration. In addition, the electrical circuitry generates heat, and in downhole environments where electrical circuitry must be enclosed to protect the circuitry from fluids in the borehole, the heat may build up without sufficient sinking, which may damage the circuitry.

SUMMARY

An embodiment of a downhole device configured to be inserted into a borehole includes a device body having an outer surface and a recess formed in the outer surface, a cover covering the recess to form a first cavity, and a shock-absorber configured to support an electrical module within the first cavity, the shock-absorber disposed between a base of the first cavity and the cover opposite the base. The downhole device also includes a vibration-damping layer disposed between the base of the first cavity and the cover, the vibration-damping layer configured to dampen vibration of the electrical module.

An embodiment of a downhole assembly having a plurality of downhole segments for being inserted in a borehole includes a first downhole segment, among the plurality of downhole segments, having a recess in an outer surface of a collar body defining a first cavity and the collar body defining a second cavity extending through the collar body, the first downhole segment including a cover covering the first cavity. The downhole assembly also includes a shock-absorber configured to support an electrical module within the first cavity, the shock-absorber disposed between a base of the first cavity and the cover opposite the base, and a vibration-damping layer disposed between the base of the first cavity and the cover, the vibration-damping layer configured to dampen vibration of the electrical module

BRIEF DESCRIPTION OF THE DRAWINGS

Referring now to the drawings wherein like elements are numbered alike in the several Figures.

DETAILED DESCRIPTION

Wellbore systems include electrical equipment located in downhole segments and devices to perform various operations, such as sensing functions, data processing functions, downhole assembly control functions, or any other functions requiring electrical circuitry. Downhole environments may be extreme and my subject the electrical equipment to high temperatures, to mechanical shock and to vibration, which may damage the electrical equipment. Embodiments of the invention relate to shock absorbers and vibration damping layers for supporting the electrical circuitry in a downhole segment or device of a downhole assembly.

Figure 1A:
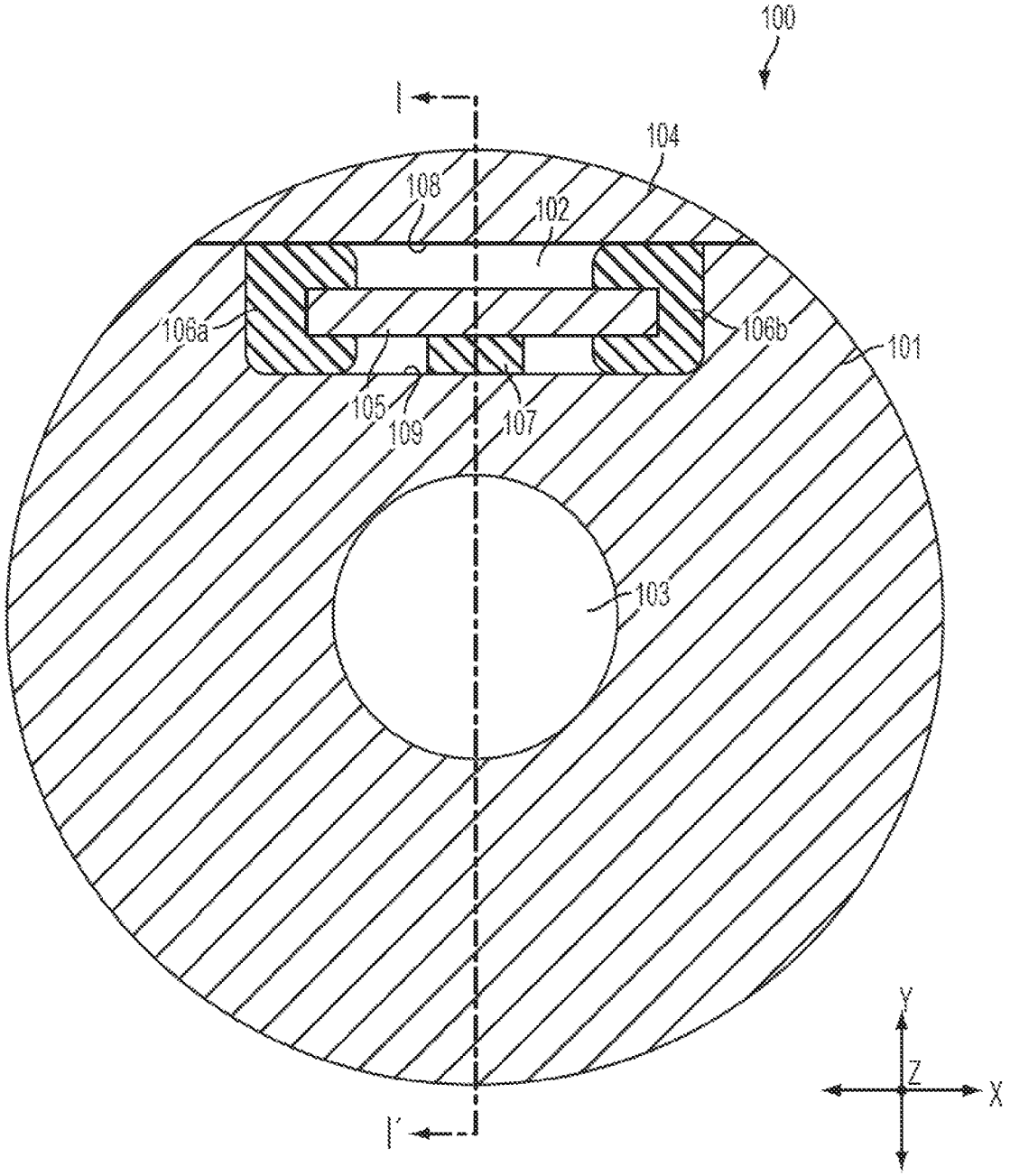
FIG. 1A is a cross-section of a downhole segment according to an embodiment of the invention.

FIG. 1A illustrates a cross-sectional view of a downhole device, and in particular a downhole segment 100 of a pipe string, according to an embodiment of the invention. The downhole segment 100 includes a collar body 101 having a recess in an outside surface of the collar body 101 defining a first cavity 102, and a cover 104 covering the first cavity 102 to form a seal. In embodiments of the invention, the cover 104 may have any shape and may be connected to the collar body 101 in any suitable manner, such that in operation while the downhole segment 100 is in a borehole, the cover 104 remains affixed to the collar body 101. Accordingly, the cover 104 may be permanently attached to the collar body 101, such as by welding, or releasably attached to the collar body 101, such as by one or more secure latches, screws, or bolts. Embodiments of the invention are not limited to any type of securing mechanism, so long as the cover 104 remains affixed to the collar body 101 in operation while the collar body 101 is in a downhole environment, such as a drilling operation in a borehole.

The cover 104 may have any shape, including a shape having a curved outer surface, as illustrated in FIG. 1, to correspond to the shape of the outer surface of the collar body 101, or the cover 104 may have an outer surface with a substantially flat shape, or any other desired shape. The cover 104 and collar body 101 may form a seal to prevent fluids from flowing into the cavity 102. The seal may be formed by welding the cover 104 to the collar body, by inserting sealing components, such as viscoelastic materials or rubber, between the collar body 101 and the cover 104, or by any other means.

In embodiments of the invention, the first cavity 102 is configured to accommodate an electrical module 105 within the cavity 102. The electrical module 105 may be any type of device, including sensor equipment or other processing circuitry, such as wiring on a printed wiring board, and one or more processors, memory chips, and other logic circuitry mounted to the printing wiring board. In one embodiment, the electrical module 105 includes electrical circuitry enclosed within a metal box for protecting the circuitry and transmitting heat from the circuitry to the surrounding environment. In addition, embodiments encompass any type of box from protecting circuitry including plastics, ceramics, or any other appropriate material selected according to design considerations.

The electrical module 105 may be or may include hybrid electronics such as a hybrid integrated circuit or hybrid microcircuit, some of which may be configured for high temperature applications. A hybrid circuit may include individual devices bonded to a printed circuit board or other substrate. Examples of hybrid electronics include a multichip module (MCM), a printed circuit board assembly (PCBA), a flexible PCB Assembly, flexible hybrid electronics (FHE), a compact integrated circuit (IC) stacked assembly and others.

In one embodiment, the electrical module 105 is or includes a MCM, which is an electronic module or assembly that includes multiple electronic components, such as integrated circuits (ICs), chips, application specific integrated circuits (ASIC) or dies (e.g., a semiconductor die), which may be mounted on a substrate and/or integrated into a single package. Examples of packages include various types of chip carriers (CC), such as leaded or leadless chip carriers (LCC), plastic leaded chip carriers (PLCC), ceramic leaded or leadless chip carriers (CLCC or LCCC), dual leaded or leadless chip carriers (DLCC), and dual in-line packages (DIP), which may be wire bonded, soldered, clamped and potted, or molded. The components may be mounted on a substrate made from a single material or multiple materials. The substrate may include any of various types of materials, such as plastics (e.g., thermoset or thermoplastic) and ceramics.

For example, the electrical module 105 can include one or more of various types of MCMs. Examples of types of MCMs include MCM-L modules made from metallic traces on organic laminate sheets, MCM-C modules that include metallic traces on ceramic layers, and MCM-D modules made from metal layers alternating with dielectric thin films.

The electrical module 105 is held in place in the cavity 102 by shock absorbers 106*a* and 106*b*. In one embodiment, the shock-absorbers 106*a* and 106*b* are made of an elastomer material. However, embodiments encompass any material capable of absorbing shock and supporting the electrical module 105. In one embodiment, the shock-absorbers 106*a* and 106*b* are made of a pre-formed elastomer, or an elastomer that has a predetermined shape prior to being placed in the cavity 102, and maintains its shape in the cavity 102, subject only to small amounts of compression and expansion due to mechanical shock and vibration and compression of the cavity 102.

In one embodiment, the shock-absorbers 106*a* and 106*b* are shaped to maintain the electrical module 105 spaced apart from the base 109 of the cavity 102 and from the surface 108 of the cover 104 defining an inside surface of the cavity 102. In other words, the shock-absorbers 106*a* and 106*b* are configured to have portions located between the surface of the electrical module 105 facing the cover 104 and portions located between the surface of the electrical module 105 and the base 109 of the cavity. In an embodiment of the invention, the shock-absorbers 106*a* and 106*b* extend from the base 109 of the cavity 102 to the inside surface 108 of the cover 104.

As illustrated in FIG. 1A, a first shock-absorber 106*a* supports a first end of the electrical module 105 and a second shock-absorber 106*b* supports a second end of the electrical module 105 opposite the first end. In one embodiment, the combination of the two shock-absorbers 106*a* and 106*b* together contact each surface of the electrical module 105, including a surface facing the cover 104, a surface facing the base 109 of the cavity 102, end surfaces of the electrical module 105 in a width direction (illustrated as direction X in FIG. 1A) and end surfaces of the electrical module 105 in a lengthwise direction (illustrated as direction Z in FIG. 1A). Accordingly, the shock-absorbers 106*a* and 106*b* contact each surface of the electrical module 105 to prevent movement of the electrical module within the cavity 102 and to maintain the electrical module 105 suspended within the cavity 102.

Since the shock-absorbers 106*a* and 106*b* have a shape that maintains the electrical module 105 in position in the cavity 102, screws or other attachment devices are not necessary to fix the electrical module 105 with respect to the collar body 101. In one embodiment, the downhole segment 100 includes no screws or other attachment mechanisms that attach to, or through, the electrical module 105 to attach the electrical module 105 to the collar body 101. In other words, in one embodiment, the shock-absorbers 106*a* and 106*b* maintain the electrical module 105 in position within the cavity 102 without the use of screws, bolts, clamps, latches, pins, or any other connection devices to connect the shock-absorbers 106*a* and 106*b* to the electrical module 105, to connect the shock-absorbers 106*a* and 106*b* to the collar body 101 or the cover 104, or to connect the electrical module 105 to the collar body 101 or cover 104.

The downhole segment 100 further includes a vibration-damping layer 107 located on the base 109 of the cavity 102 and configured to be in contact with a surface of the electrical module 105 to damp vibration of the electrical module 105. In one embodiment, the vibration-damping layer 107 is located between the first shock absorber 106*a* and the second shock absorber 106*b*.

The downhole segment 100 includes a second cavity 103 extending through the collar body 101 from one end of the collar body 101 to an opposite end. In one embodiment, the downhole segment 100 is configured to have fluid, such as borehole fluid, drilling mud, or any other fluid, flow through the second cavity 103. In one embodiment, the vibration-damping layer 107 is a thermal-transmitting material for transmitting heat from the electrical module 105 to the collar body 101, and from the collar body 101 to the fluid in the second cavity 103.

In one embodiment, the vibration-damping layer 107 is made of a viscoelastic material. The viscoelastic material may be a pre-formed material, such as a pad, or the viscoelastic material may be a paste or other material that is deposited in the cavity 102. Then the electrical module 105 may be placed on the viscoelastic material, and the viscoelastic material may harden into the vibration-damping layer 107.

FIG. 1A illustrates a cross-section of the downhole segment 100 along a plane perpendicular to a length axis Z of the downhole segment 100. In other words, in an embodiment in which the downhole segment 100 is formed as a cylinder, the length axis Z corresponds to the axis through the cavity 103 at the center of the cylinder. For purposes of description, the axis Y is referred to as the height direction of the downhole segment 100, the axis X is referred to as a width direction of the downhole segment 100, and the axis Z is referred to as the length direction of the downhole segment 100.

Figure 1B:
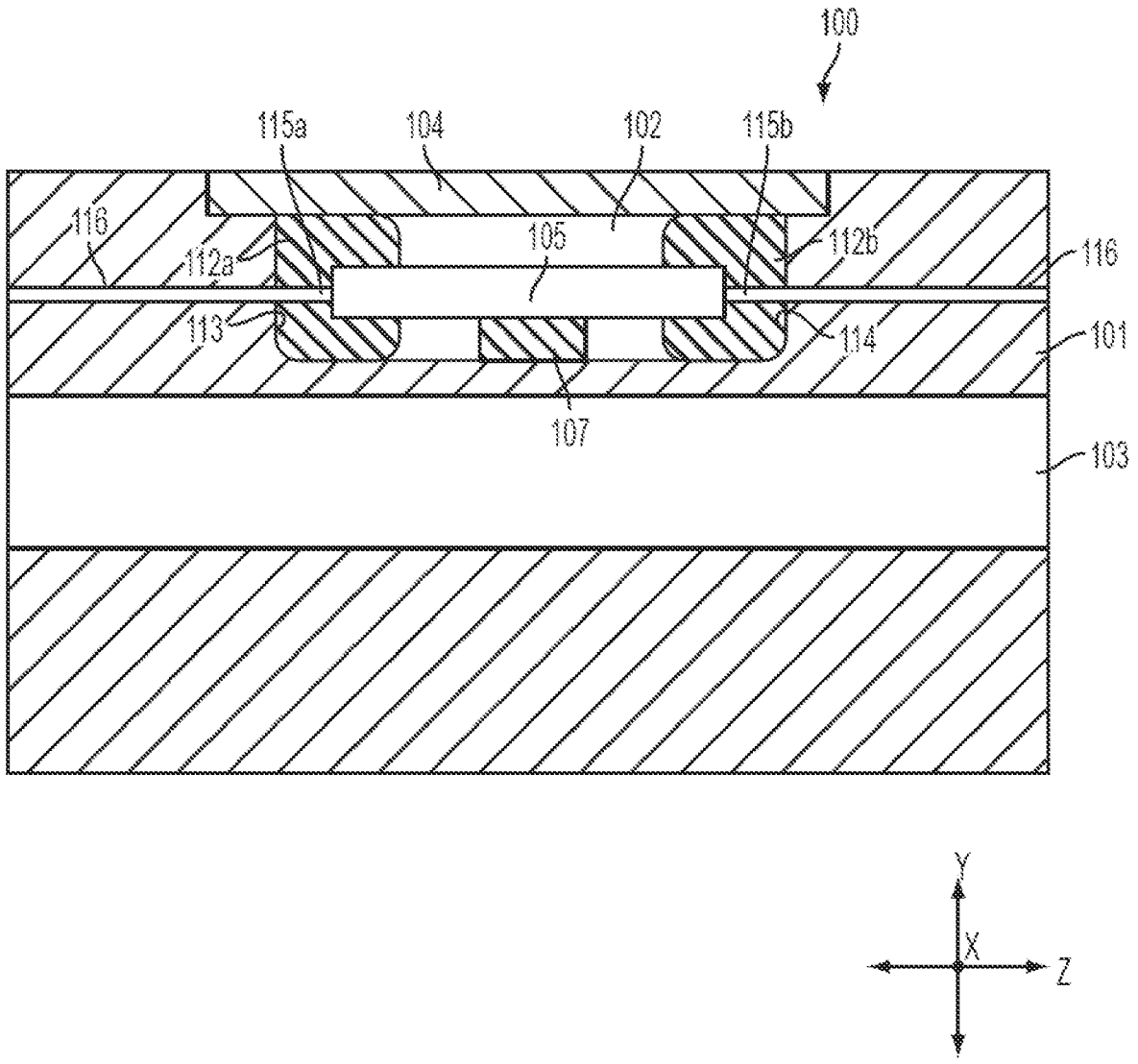
FIG. 1B is another cross-section of a downhole segment according to an embodiment.

FIG. 1B is a side cross-sectional view taken along the line I-I' of FIG. 1A to illustrate a length of the downhole segment 100, or at least a portion of the length of the downhole segment 100. As illustrated in FIG. 1B, the downhole segment 100 includes third and fourth shock-absorbers 112*a* and 112*b* located at the length ends of the electrical module 105. While four shock-absorbers 106*a*, 106*b*, 112*a*, and 112*b* are illustrated in FIGS. 1A and 1B, embodiments of the invention encompass any number of shock-absorbers, including one shock-absorber having a shape sufficient to support the entire electrical module 105 by running along the top or one or more sides of the electrical module (such as in a rectangular frame shape), two, three, or five or more shock-absorbers. In one embodiment, only two shock-absorbers are used, located at the width ends of the electrical module 105, as illustrated in FIG. 1A, or located at the length ends of the electrical module 105, as illustrated in FIG. 1B.

The shock absorbers 112*a* and 112*b* include channels 115*a* and 115*b* aligned with a channel 116 in the collar body 105 to allow a wire to be connected to the electrical module 105 and to extend through the downhole segment 100 to another downhole segment or other equipment.

In the embodiment illustrated in FIGS. 1A and 1B, the electrical module 105 has a length greater than its width, its length extends along the length direction Z of the downhole segment 100 and its width extends in the width direction X of the downhole segment 100. However, embodiments of the invention are not limited to the configuration illustrated in FIGS. 1A and 1B. Instead, embodiments encompass any arrangement of the electrical module 105 relative to the collar body 101, including having a length extending in the width direction X of the downhole segment 100, having a length extending in the height direction Y of the downhole segment 100, having a same width and height, having an irregular or non-geometric shape, being arranged to be non-co-axial with any of the width direction X, height direction Y, and length direction Z, or having any other arrangement.

Figure 2:
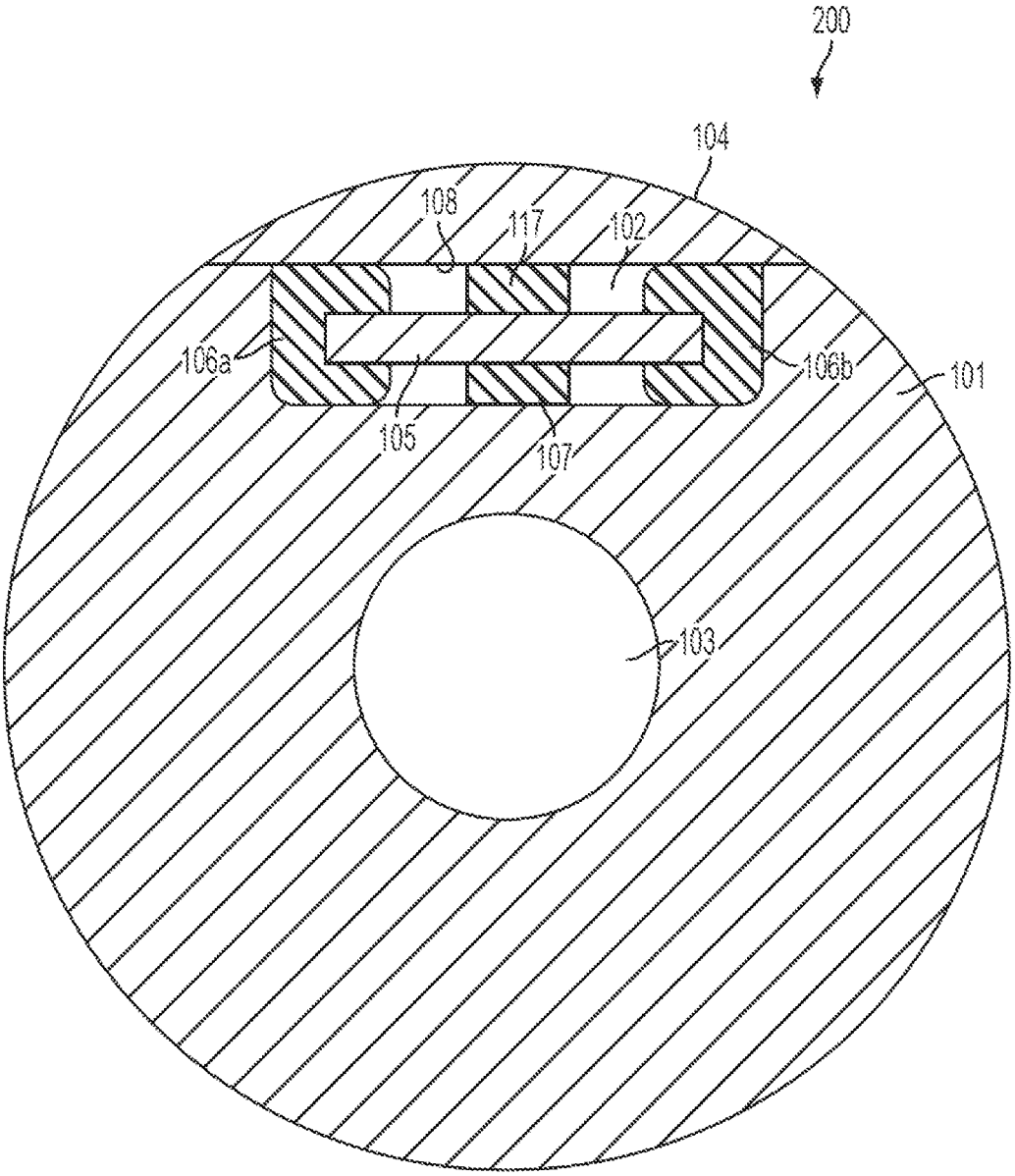
FIG. 2 is a cross-section of a downhole segment of a downhole assembly according to an embodiment of the invention.

While FIGS. 1A and 1B illustrate four shock absorbers 106*a*, 106*b*, 112*a* and 112*b*, and only one vibration-damping layer 107, embodiments of the invention encompass any number of shock absorbers and vibration-damping layers. FIG. 2 illustrates an embodiment of the invention similar to FIG. 1A, but further including a second vibration-damping layer 117 between the electrical module 105 and the inside surface 108 of the cover 104.

Figure 3:
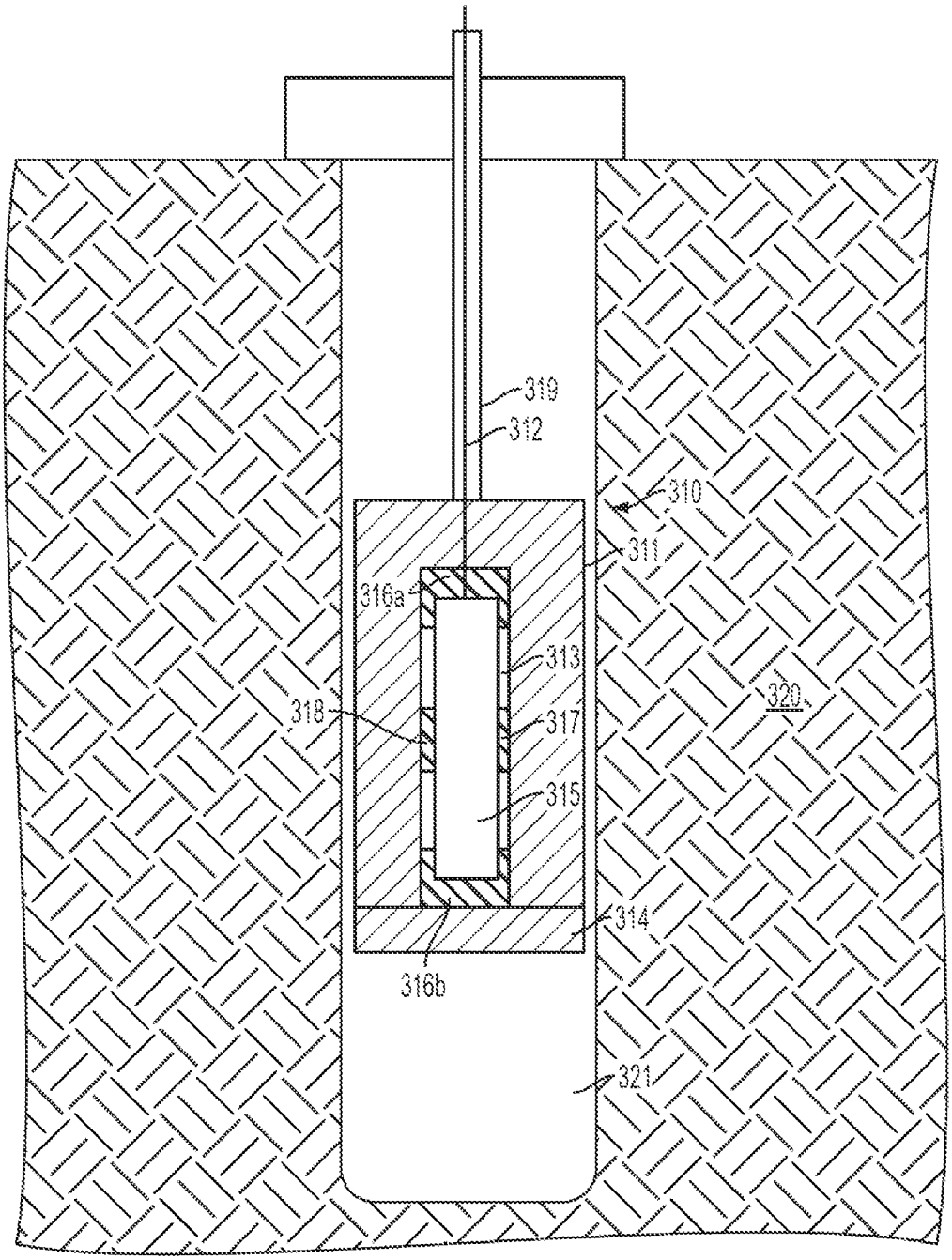
FIG. 3 is a cross-section of a downhole probe device according to an embodiment of the invention.

FIG. 3 illustrates a downhole device according to another embodiment of the invention. In FIG. 3, the downhole device is a probe 310 that is configured to obtain measurements in the borehole 321 formed in an earth formation 320. The probe 310 includes a housing 311 suspended by a cable 312. Alternatively, the probe 310 may be connected to a downhole pipe or other structure to push the probe 310 into the wellbore 321 and support the probe 310 within the wellbore 321. A recess 313 is formed in an end surface of the housing 311 to form a cavity 313 when a cover 314 is attached to an end of the housing 311. The cover 314 forms a fluid-tight seal with the housing 311 to prevent fluids from flowing into or out from the cavity 313.

An electrical module 315 is located in the cavity 313 and may correspond to the electrical module 105 described in connection with FIG. 1A. The electrical module 315 may include one or more measurement devices, such as antenna or other transmitters or receivers, and one or more processing circuits to process signals generated by measurement devices, to process signals generated by uphole computers to control or monitor operation of the probe 310, or to process any other signals generated in connection with operation of the probe 310. The probe 310 includes shock-absorbers 316*a* and 316*b* and vibration-damping layers 317 and 318. The shock-absorbers may correspond to the shock-absorbers 106*a* and 106*b* described in connection with FIGS. 1A and 1B, and the vibration-damping layers may correspond to the vibration-damping layers 107 and 117 described in connection with FIGS. 1A, 1B, and 2.

While downhole segments, such as pipe segments, and probes have been illustrated to provide examples of embodiments of the invention, embodiments are not limited to the disclosed examples. Instead, embodiments of the invention may be implemented in connection with any type of apparatus or device that is configured to be inserted into a borehole in an earth formation.

In addition, while FIGS. 1A, 1B, and 2 illustrate a cover located on a side surface (or a surface located radially outward from the center of the downhole segment), and FIG. 3 illustrates a cover located at one end of a downhole device (i.e. a surface located along an axial length of the device), embodiments encompass covers located on any surface, or multiple surfaces, of a downhole device, including either end and any side surface.

Figure 4:
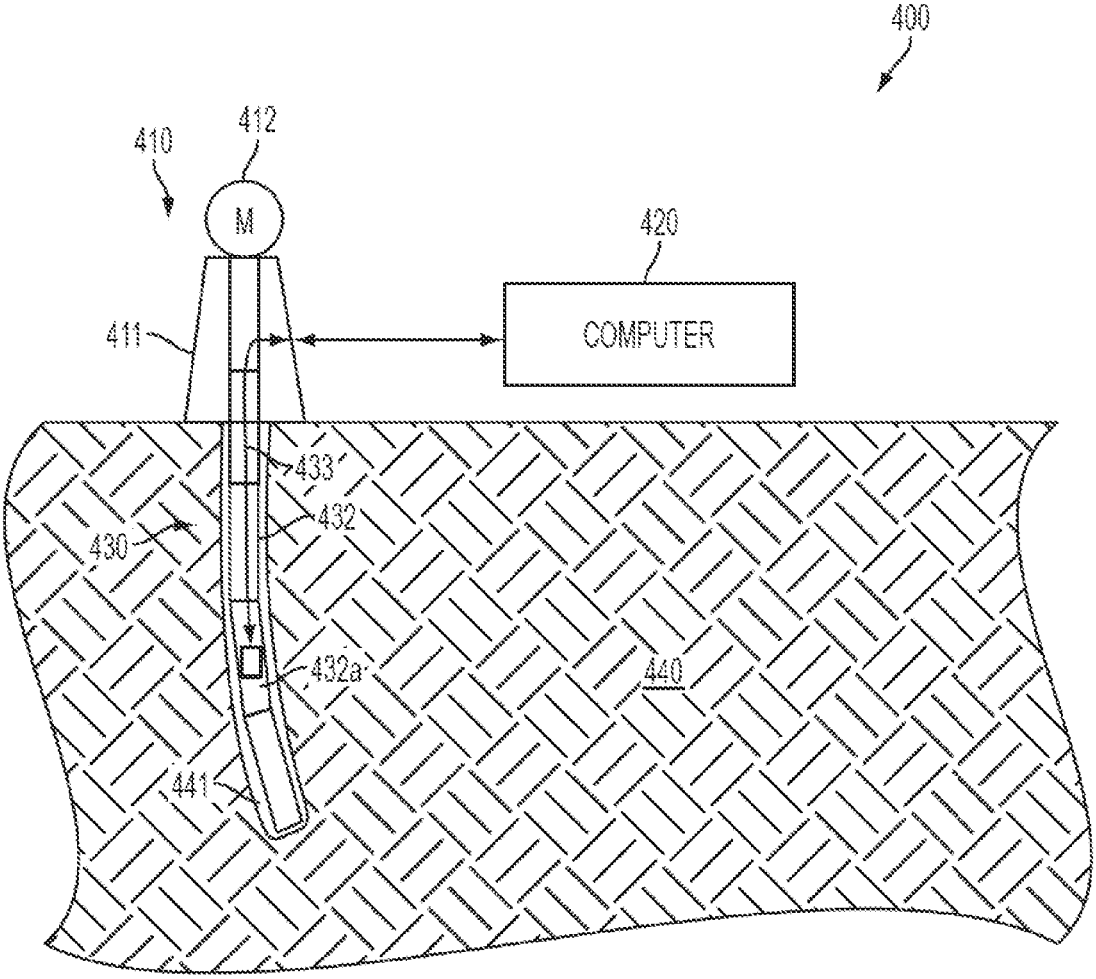
FIG. 4 is a borehole system according to an embodiment of the invention.

FIG. 4 illustrates a borehole system 400 according to an embodiment of the invention. The system 400 includes a downhole assembly 410 connected to an above-ground computer 420, which may perform one or more of monitoring and control of the downhole assembly 410. The downhole assembly 410 includes a derrick 411 and motor 412 above ground, and a downhole potion 430 including one or more downhole segments 432 in a borehole 441 of an earth formation 440. In FIG. 4, the downhole segment 432*a* represents the downhole segment 100 of FIGS. 1A and 1B, including the cavity 102, electrical module 105, shock-absorbers 106*a*, 106*b*, 112*a*, and 112*b*, and vibration-damping layer 107. The electrical module 105 of the downhole segment 432*a* communicates with the computer 420 via a wire 433 that extends through the downhole segments 432. The wire 433 may be any type of wire, including copper or other conductive metal or fiber optic wire. In addition, embodiments of the invention encompass any type of communication between the computer 420 and the electrical module 105, including mud pulse telemetry, electromagnetic telemetry, or any other type of communication.

In embodiments of the invention, the shock absorbers and vibration-damping layer protect the electrical module during operation of the downhole assembly 410, such as during a drilling operation or well completion operation. Since the electrical module is securely fit in the shock-absorbers, screws or other fixing mechanisms are not needed to mechanically fix the electrical module to the collar body of the downhole segment. As a result, when the electrical module is subject to mechanical shock and vibration, the electrical module is not subjected to stress and certain points where screws or other fixing devices are fixed with respect to the collar body.

In addition, the shock absorbers may be unattached to the collar body (i.e. no adhesive, screws, or other fixing means may be used), and instead, the shock-absorbers may fit snugly within the space of the cavity in the collar body. As a result, if an operator needs to access the electrical module, the cover may be removed from the cavity and the electrical module and shock absorbers may be removed without the need to unscrew, un-attach, or break any fixing mechanisms.

In one embodiment of the invention, the shock absorbers are pre-formed material having a shape designed to correspond to the shape of an electrical module to be supported by the shock absorbers. The shock absorbers are designed to have a shape such that when the electrical module is positioned in the shock absorbers to be supported by the shock absorbers, the shock absorbers contact the inside surfaces of a cavity in a collar body to prevent movement of the electrical module with respect to the collar body. For example, if two shock absorbers are used to support length ends of the electrical module, the height of the shock absorbers is the height of the cavity with the cover attached, a width of the shock absorbers is the width of the cavity, and portions of the shock absorbers are located between the ends of the electrical modules and walls of the cavity, such that the length of the electrical module and the portions of the shock absorbers located between the ends of the electrical modules and walls of the cavity have the same length as the length of the cavity. Accordingly, no screws or other attaching mechanisms are needed to keep the electrical module in place within the cavity, so that no stress points are generated on the electrical module and insertion and removal of the electrical module and shock absorbers is facilitated or made easier than when any fixing or attaching mechanisms are used.

Figure 5:
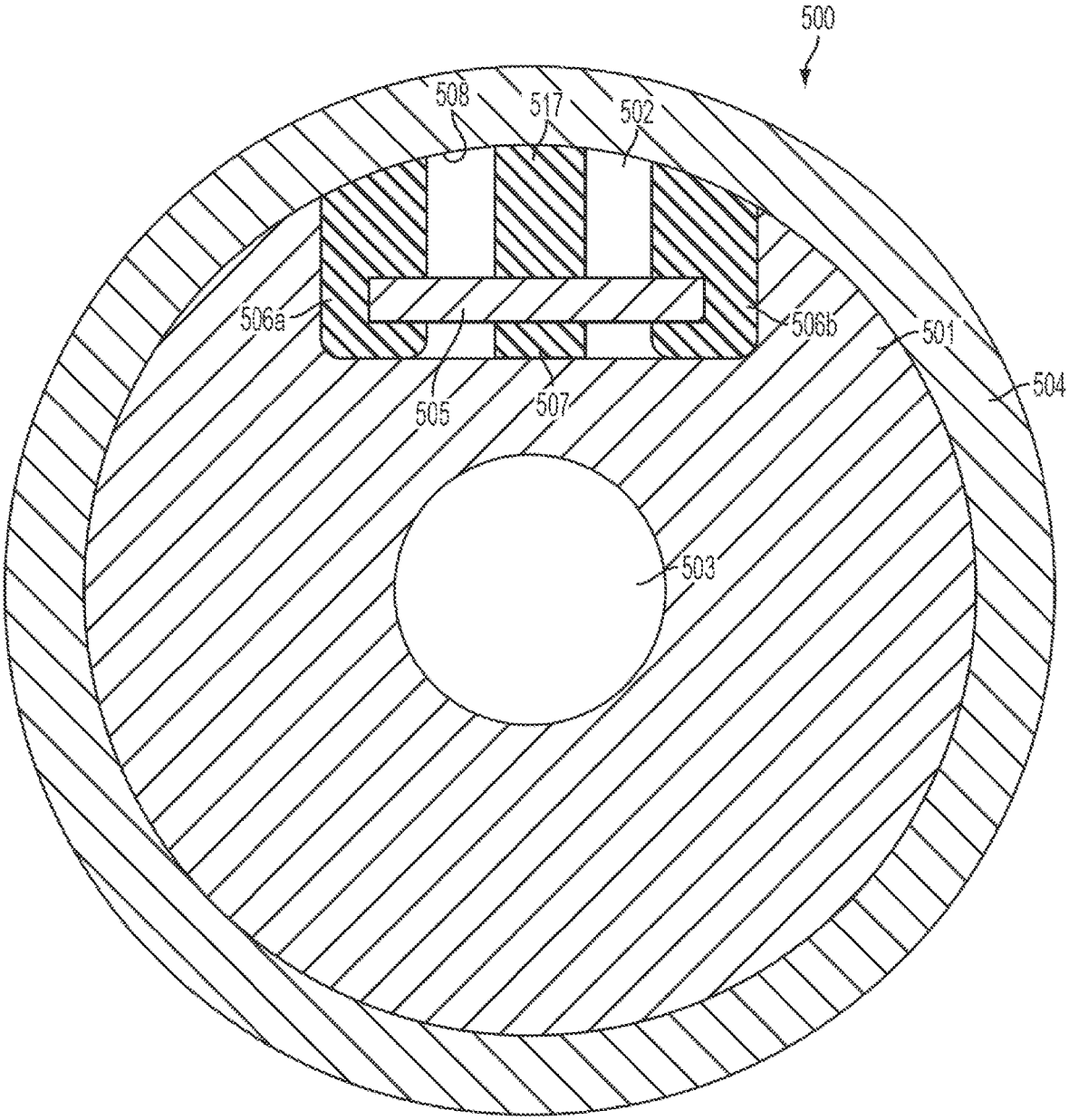
FIG. 5 is a cross-section of a downhole segment according to another embodiment.

While embodiments have been provided in which a cover covers a portion of a collar body having a recess, embodiments encompass covers of any shape relative to the collar body. For example, FIG. 5 illustrates a cross-sectional view of a downhole device, and in particular a downhole segment 500 of a pipe string, according to an embodiment of the invention. The downhole segment 500 includes a collar body 501 having a recess in an outside surface of the collar body 501 defining a first cavity 502, and a cover 504, which in the embodiment illustrated in FIG. 5 is a sleeve, covering the entire outer radial surface of the collar body 501 including the first cavity 502 to form a seal.

In embodiments of the invention, the first cavity 502 is configured to accommodate an electrical module 505 within the cavity 502. The electrical module 505 may be any type of device, including sensor equipment or other processing circuitry, such as wiring on a printed wiring board, and one or more processors, memory chips, and other logic circuitry mounted to the printing wiring board. In one embodiment, the electrical module 505 includes electrical circuitry enclosed within a metal box for protecting the circuitry and transmitting heat from the circuitry to the surrounding environment. In addition, embodiments encompass any type of box from protecting circuitry including plastics, ceramics, or any other appropriate material selected according to design considerations.

The electrical module 505 is held in place in the cavity 502 by shock absorbers 506*a* and 506*b*. In one embodiment, the shock-absorbers 506*a* and 506*b* are made of an elastomer material. However, embodiments encompass any material capable of absorbing shock and supporting the electrical module 505. In one embodiment, the shock-absorbers 506*a* and 506*b* are made of a pre-formed elastomer, or an elastomer that has a predetermined shape prior to being placed in the cavity 502, and maintains its shape in the cavity 502, subject only to small amounts of compression and expansion due to mechanical shock and vibration and compression of the cavity 502.

In one embodiment, the shock-absorbers 506*a* and 506*b* are shaped to maintain the electrical module 505 spaced apart from the base 509 of the cavity 502 and from the surface 508 of the cover 504 defining an inside surface of the cavity 502. In other words, the shock-absorbers 506*a* and 506*b* are configured to have portions located between the surface of the electrical module 505 facing the cover 504 and portions located between the surface of the electrical module 505 and the base 509 of the cavity. In an embodiment of the invention, the shock-absorbers 506*a* and 506*b* extend from the base 509 of the cavity 502 to the inside surface 508 of the cover 504.

The downhole segment 500 further includes a vibration-damping layer 507 located on the base of the cavity 502 and configured to be in contact with a surface of the electrical module 505 to damp vibration of the electrical module 505. In one embodiment, the vibration-damping layer 507 is located between the first shock absorber 506*a* and the second shock absorber 506*b*. Another vibration-damping layer 517 is located between the electrical module 505 and the cover 504.

The downhole segment 500 includes a second cavity 503 extending through the collar body 501 from one end of the collar body 501 to an opposite end. In one embodiment, the downhole segment 500 is configured to have fluid, such as borehole fluid, drilling mud, or any other fluid, flow through the second cavity 503. In one embodiment, the vibration-damping layer 507 is a thermal-transmitting material for transmitting heat from the electrical module 505 to the collar body 501, and from the collar body 501 to the fluid in the second cavity 503.

In one embodiment, the vibration-damping layer 507 is made of a viscoelastic material. The viscoelastic material may be a pre-formed material, such as a pad, or the viscoelastic material may be a paste or other material that is deposited in the cavity 502. Then the electrical module 505 may be placed on the viscoelastic material, and the viscoelastic material may harden into the vibration-damping layer 107.

Figure 6:
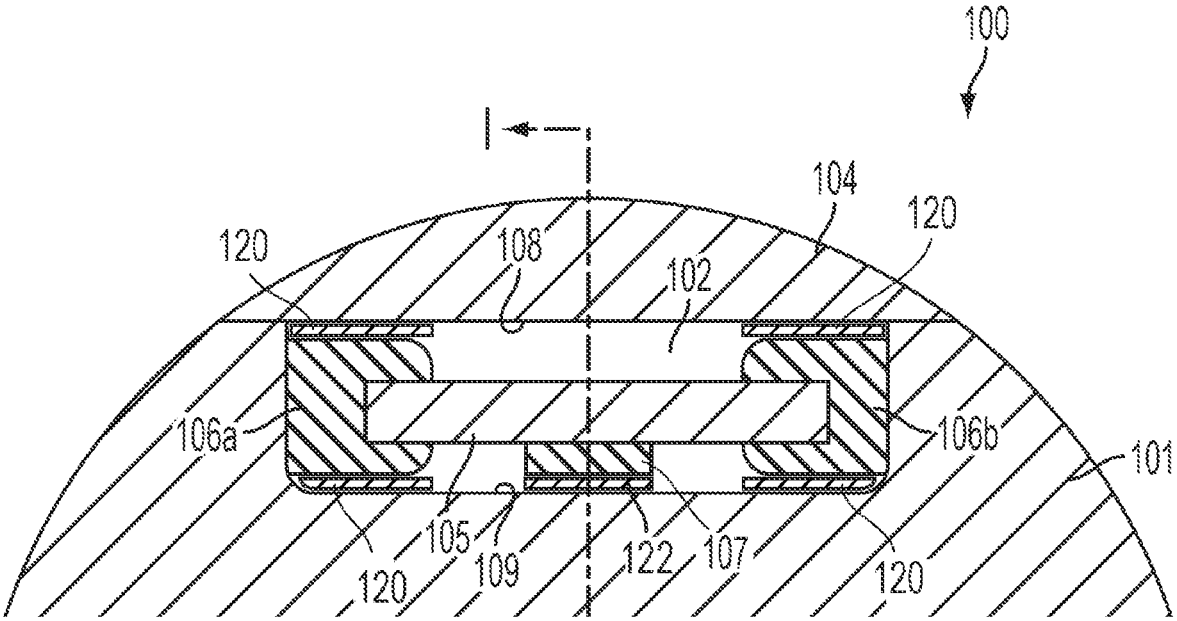
FIG. 6 is a cross-section of a downhole segment according to another embodiment.

The downhole device or component may include one or more elements disposed between a shock absorber or absorbers and another surface, and/or one or more elements disposed between a vibration-damping layer or layers and another surface. For example, as shown in FIG. 6, the downhole segment 100 can include one or more layers or elements 120 disposed between the shock absorber 106*a* and one or more surfaces of the cavity 102, the electrical component 105 and/or the cover 104. The downhole segment 100 in this example can also include one or more layers or elements 120 disposed between the shock absorber 106*b* and one or more surfaces of the cavity 102, the electrical component 105 and/or the cover 104. In addition, one or more elements 122 may be disposed between the vibration-damping layer 107 and a surface of the cavity 102, a surface of the cover 104 and/or a surface of the electrical component 105.

The elements 120 and 122 can be made from any desired material and have any suitable thickness. Such materials may include plastics, elastomers and other materials. The material making up an element can be a thermal-transmitting material that facilitates heat transfer from the electrical module 105.

It is noted that the elements 120 and 122 may be placed at or near any surface of the downhole segment 100 and/or the electrical module 105, and between any of the surfaces of the shock absorber 106*a*, the shock absorber 106*b*, the vibration-damping layer 107 and the downhole segment 100. As such, the number and configuration of elements are not limited to the embodiments discussed herein.

The elements 120 and 122 allow the shock absorber 106*a*, the shock absorber 106*b* and/or the vibration-damping layer 107 to perform their respective functions without directly contacting surfaces of the cavity 102, the electrical module 105 and/or the cover 104.

Set forth below are some embodiments of the foregoing disclosure:

Embodiment 1. A downhole device configured to be inserted into a borehole, the downhole device comprising: a device body having an outer surface and a recess formed in the outer surface; a cover covering the recess to form a first cavity; a shock-absorber configured to support an electrical module within the first cavity, the shock-absorber disposed between a base of the first cavity and the cover opposite the base; and a vibration-damping layer disposed between the base of the first cavity and the cover, the vibration-damping layer configured to dampen vibration of the electrical module.

Embodiment 2. The downhole device of any prior embodiment, wherein the downhole device is a segment of a downhole assembly, and the device body is a collar body defining a second cavity extending end-to-end through the collar body.

Embodiment 3. The downhole device of any prior embodiment, wherein the second cavity is configured to have a fluid flow therethrough, and the vibration-damping layer is made of a temperature-transmitting material configured to transmit heat from the electrical module, through the vibration-damping layer and the collar body, to the fluid.

Embodiment 4. The downhole device of any prior embodiment, wherein the shock-absorber extends between the base and the inner surface of the cover, and engages both the base and the inner surface of the cover to dampen vibration.

Embodiment 5. The downhole device of any prior embodiment, wherein the shock-absorber engages at least one of the base and the inner surface of the cover to dampen vibration.

Embodiment 6. The downhole device of any prior embodiment, wherein the vibration damping layer includes at least one of a first side that engages the base and a second side that engages a surface of the electrical module opposite the base.

Embodiment 7. The downhole device of any prior embodiment, wherein the shock-absorber includes a first shock-absorber configured to support a first end of the electrical module and a second shock-absorber configured to support a second end of the electrical module opposite the first end.

Embodiment 8. The downhole device of any prior embodiment, wherein the vibration-damping layer is located between the first shock-absorber and the second shock-absorber.

Embodiment 9. The downhole device of any prior embodiment, wherein the shock-absorber is configured to maintain the electrical module stationary within the first cavity by contacting a first surface of the electrical module facing the base of the first cavity, and by contacting a second surface of the electrical module opposite the first surface and facing the cover.

Embodiment 10. The downhole device of any prior embodiment, wherein the shock-absorber is configured to maintain the electrical module stationary within the first cavity without screws, bolts, clamps, latches, and pins.

Embodiment 11. The downhole device of any prior embodiment, wherein the shock-absorber is a pre-formed elastomer.

Embodiment 12. The downhole device of aby prior embodiment, wherein the vibration-damping layer is made of a viscoelastic material.

Embodiment 13. A downhole assembly having a plurality of downhole segments for being inserted in a borehole, the downhole assembly comprising: a first downhole segment, among the plurality of downhole segments, having a recess in an outer surface of a collar body defining a first cavity and the collar body defining a second cavity extending through the collar body, the first downhole segment including a cover covering the first cavity; a shock-absorber configured to support an electrical module within the first cavity, the shock-absorber disposed between a base of the first cavity and the cover opposite the base; and a vibration-damping layer disposed between the base of the first cavity and the cover, the vibration-damping layer configured to dampen vibration of the electrical module.

Embodiment 14. The downhole assembly of any prior embodiment, wherein the shock-absorber includes a first shock-absorber configured to support a first end of the electrical module and a second shock-absorber configured to support a second end of the electrical module opposite the first end.

Embodiment 15. The downhole assembly of any prior embodiment, wherein the vibration-damping layer is located between the first shock-absorber and the second shock-absorber.

Embodiment 16. The downhole assembly of any prior embodiment, wherein the plurality of downhole segments include a channel configured to have fluid flow therethrough, the second cavity being part of the channel, the vibration-damping layer being made of a temperature-transmitting material for transmitting heat from the electrical module, through the vibration-damping layer and the collar body to the fluid.

Embodiment 17. The downhole assembly of any prior embodiment, wherein the shock-absorber is configured to maintain the electrical module stationary within the first cavity by engaging at least one surface of the electrical module.

Embodiment 18. The downhole assembly of any prior embodiment, wherein the shock-absorber is configured to maintain the electrical module stationary within the first cavity without screws, bolts, clamps, latches or pins.

Embodiment 19. The downhole assembly of any prior embodiment, wherein the shock-absorber is a pre-formed elastomer.

Embodiment 20. A downhole device configured to be inserted into a borehole includes a device body having an outer surface and a recess formed in the outer surface, a cover covering the recess to form a first cavity, and a shock-absorber configured to support an electrical module within the first cavity, the shock-absorber disposed between a base of the first cavity and the cover opposite the base. The downhole device also includes a vibration-damping layer disposed between the base of the first cavity and the cover, the vibration-damping layer configured to dampen vibration of the electrical module.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A downhole device configured to be inserted into a borehole, the downhole device comprising:

a device body having a longitudinal axis, an outer surface and a recess formed in the outer surface;

a cover covering the recess to form a first cavity;

a first shock-absorber configured to absorb mechanical shock to protect an electrical module and configured to support the electrical module within the first cavity, and a second shock-absorber separated from the first shock-absorber, the electrical module having a length in a direction parallel to the longitudinal axis and a width in a direction perpendicular to the longitudinal axis and perpendicular to a radius of the device body, the second shock-absorber configured to absorb mechanical shock to protect the electrical module and configured to support the electrical module within the first cavity, the first shock-absorber and the second shock-absorber disposed between a base of the first cavity and the cover opposite the base, the first shock-absorber and the second shock-absorber disposed at opposing ends of the width of the electrical module or disposed at opposing ends of the length of the electrical module; and a vibration-damping layer disposed between the base and the cover, the vibration-damping layer configured to dampen mechanical vibration of the electrical module.

2. The downhole device of claim 1, wherein the downhole device is a segment of a downhole assembly, and the device body is a collar body defining a second cavity extending end-to-end through the collar body.

3. The downhole device of claim 1, wherein at least one of the first shock-absorber and the second shock-absorber extends between the base and an inner surface of the cover, and engages both the base and the inner surface of the cover to dampen vibration.

4. The downhole device of claim 1, wherein the first shock-absorber and the second shock-absorber are disposed between the base of the cavity and the electrical module.

5. The downhole device of claim 1, wherein the vibration-damping layer includes a first side that engages the base and a second side that engages a surface of the electrical module opposite the base.

6. The downhole device of claim 1, wherein the first shock-absorber is disposed at a first end of the electrical module and configured to support the first end of the electrical module and the second shock-absorber is disposed at a second end of the electrical module and configured to support the second end of the electrical module, the second end of the electrical module being opposite the first end.

7. The downhole device of claim 6, wherein the vibration-damping layer is located between the first shock-absorber and the second shock-absorber.

8. The downhole device of claim 1, wherein the first shock-absorber and the second shock-absorber are configured to maintain the electrical module stationary within the first cavity without screws, bolts, clamps, latches, and pins.

9. The downhole device of claim 1, wherein at least one of the first shock-absorber and the second shock-absorber is a pre-formed elastomer.

10. The downhole device of claim 1, wherein the vibration-damping layer is made of a viscoelastic material.

11. A downhole device, configured to be inserted into a borehole, the downhole device comprising:

a device body having an outer surface and a recess formed in the outer surface;

a cover covering the recess to form a first cavity;

a first shock-absorber configured to absorb mechanical shock to protect an electrical module and configured to support the electrical module within the first cavity, and a second shock-absorber separated from the first shock-absorber, the second shock-absorber configured to absorb mechanical shock to protect the electrical module and configured to support the electrical module within the first cavity, the first shock-absorber and the second shock-absorber disposed between a base of the first cavity and the cover opposite the base; and a vibration-damping layer disposed between the base and the cover, the vibration-damping layer configured to dampen mechanical vibration of the electrical module, wherein the downhole device is a segment of a downhole assembly, and the device body is a collar body defining a second cavity extending end-to-end through the collar body, and wherein the second cavity is configured to have a fluid flow therethrough, and the vibration-damping layer is made of a temperature-transmitting material configured to transmit heat from the electrical module, through the vibration-damping layer and the collar body, to the fluid.

12. A downhole device, configured to be inserted into a borehole, the downhole device comprising:

a device body having an outer surface and a recess formed in the outer surface;

a cover covering the recess to form a first cavity;

a first shock-absorber configured to absorb mechanical shock to protect an electrical module and configured to support the electrical module within the first cavity, and a second shock-absorber separated from the first shock-absorber, the second shock-absorber configured to absorb mechanical shock to protect the electrical module and configured to support the electrical module within the first cavity, the first shock-absorber and the second shock-absorber disposed between a base of the first cavity and the cover opposite the base; and a vibration-damping layer disposed between the base and the cover, the vibration-damping layer configured to dampen mechanical vibration of the electrical module, wherein at least one of the first shock-absorber and the second shock-absorber is configured to maintain the electrical module stationary within the first cavity by contacting a first surface of the electrical module facing the base of the first cavity, and by contacting a second surface of the electrical module opposite the first surface and facing the cover.

13. A downhole assembly having a plurality of downhole segments for being inserted in a borehole, the downhole assembly comprising:

a first downhole segment, among the plurality of downhole segments, having a longitudinal axis, the first downhole segment having a recess in an outer surface of a collar body defining a first cavity, the collar body defining a second cavity extending through the collar body, the first downhole segment including a cover covering the first cavity;

a first shock-absorber configured to absorb mechanical shock to protect an electrical module and configured to support the electrical module within the first cavity, and a second shock-absorber separated from the first shock-absorber, the electrical module having a length in a direction parallel to the longitudinal axis and a width in a direction perpendicular to the longitudinal axis and perpendicular to a radius of the first downhole segment, the second shock-absorber configured to absorb mechanical shock to protect the electrical module and configured to support the electrical module within the first cavity, the first shock-absorber and the second shock-absorber disposed between a base of the first cavity and the cover opposite the base, the first shock-absorber and the second shock-absorber disposed at opposing ends of the width of the electrical module or disposed at opposing ends of the length of the electrical module; and a vibration-damping layer disposed between the base and the cover, the vibration-damping layer configured to dampen mechanical vibration of the electrical module.

14. The downhole assembly of claim 13, wherein the first shock-absorber is disposed at a first end of the electrical module and configured to support the first end of the electrical module and the second shock-absorber is disposed at a second end of the electrical module and configured to support the second end of the electrical module, the second end of the electrical module being opposite the first end.

15. The downhole assembly of claim 14, wherein the vibration-damping layer is located between the first shock-absorber and the second shock-absorber.

16. The downhole assembly of claim 13, wherein the first shock-absorber and the second shock-absorber are configured to maintain the electrical module stationary within the first cavity by engaging at least one surface of the electrical module.

17. The downhole assembly of claim 13, wherein the first shock-absorber and the second shock-absorber are configured to maintain the electrical module stationary within the first cavity without screws, bolts, clamps, latches or pins.

18. The downhole assembly of claim 13, wherein at least one of the first shock-absorber and the second shock-absorber is a pre-formed elastomer.

19. The downhole assembly of claim 13, wherein the vibration-damping layer is made of a viscoelastic material.

20. A downhole assembly, having a plurality of downhole segments for being inserted in a borehole, the downhole assembly comprising:

a first downhole segment, among the plurality of downhole segments, having a recess in an outer surface of a collar body defining a first cavity, the collar body defining a second cavity extending through the collar body, the first downhole segment including a cover covering the first cavity;

a first shock-absorber configured to absorb mechanical shock from to protect an electrical module and configured to support the electrical module within the first cavity, and a second shock-absorber separated from the first shock-absorber, the second shock-absorber configured to absorb mechanical shock to protect the electrical module and configured to support the electrical module within the first cavity, the first shock-absorber and the second shock-absorber disposed between a base of the first cavity and the cover opposite the base; and a vibration-damping layer disposed between the base and the cover, the vibration-damping layer configured to dampen mechanical vibration of the electrical module, wherein the plurality of downhole segments include a channel configured to have a fluid flow therethrough, the second cavity being part of the channel, the vibration-damping layer being made of a temperature-transmitting material for transmitting heat from the electrical module, through the vibration-damping layer and the collar body to the fluid.

* * * * *